United States Patent [19]

Neighbor

[11] 4,303,598

[45] Dec. 1, 1981

[54] VACUUM CONTROL ASSEMBLY

[75] Inventor: Larry A. Neighbor, Holland, Mich.

[73] Assignee: BLD Products, Ltd., Holland, Mich.

[21] Appl. No.: 164,807

[22] Filed: Jun. 30, 1980

[51] Int. Cl.[3] ..... F02M 1/10

[52] U.S. Cl. ..... 261/39 B; 91/443; 137/513.3

[58] Field of Search ..... 261/39 B; 91/443; 123/409; 137/513.3

[56] References Cited

U.S. PATENT DOCUMENTS

| | | | |
|---|---|---|---|
| 3,486,742 | 12/1969 | Szwargulski | 261/39 B |
| 3,902,469 | 9/1975 | Scott, Jr. | 123/409 |
| 3,991,731 | 11/1976 | Benjamin | 261/39 B |
| 4,027,634 | 6/1977 | Benjamin | 261/39 B |
| 4,100,894 | 7/1978 | Tamura | 123/409 |
| 4,126,084 | 11/1978 | Inada et al. | 91/443 |

FOREIGN PATENT DOCUMENTS

| | | | |
|---|---|---|---|
| 807869 | 7/1951 | Fed. Rep. of Germany | 137/513.3 |

*Primary Examiner*—Tim R. Miles

*Attorney, Agent, or Firm*—Fisher, Gerhardt, Crampton & Groh

[57] ABSTRACT

A vacuum control assembly wherein a vacuum motor is operated at a delayed rate in one direction under the control of a valve assembly holding a filter and valve closure element all supported in operating position without requiring the use of fasteners, press fits or welding and providing the multiple functions of a seal, a filter compartment, a valve housing, and spring seat.

9 Claims, 1 Drawing Figure

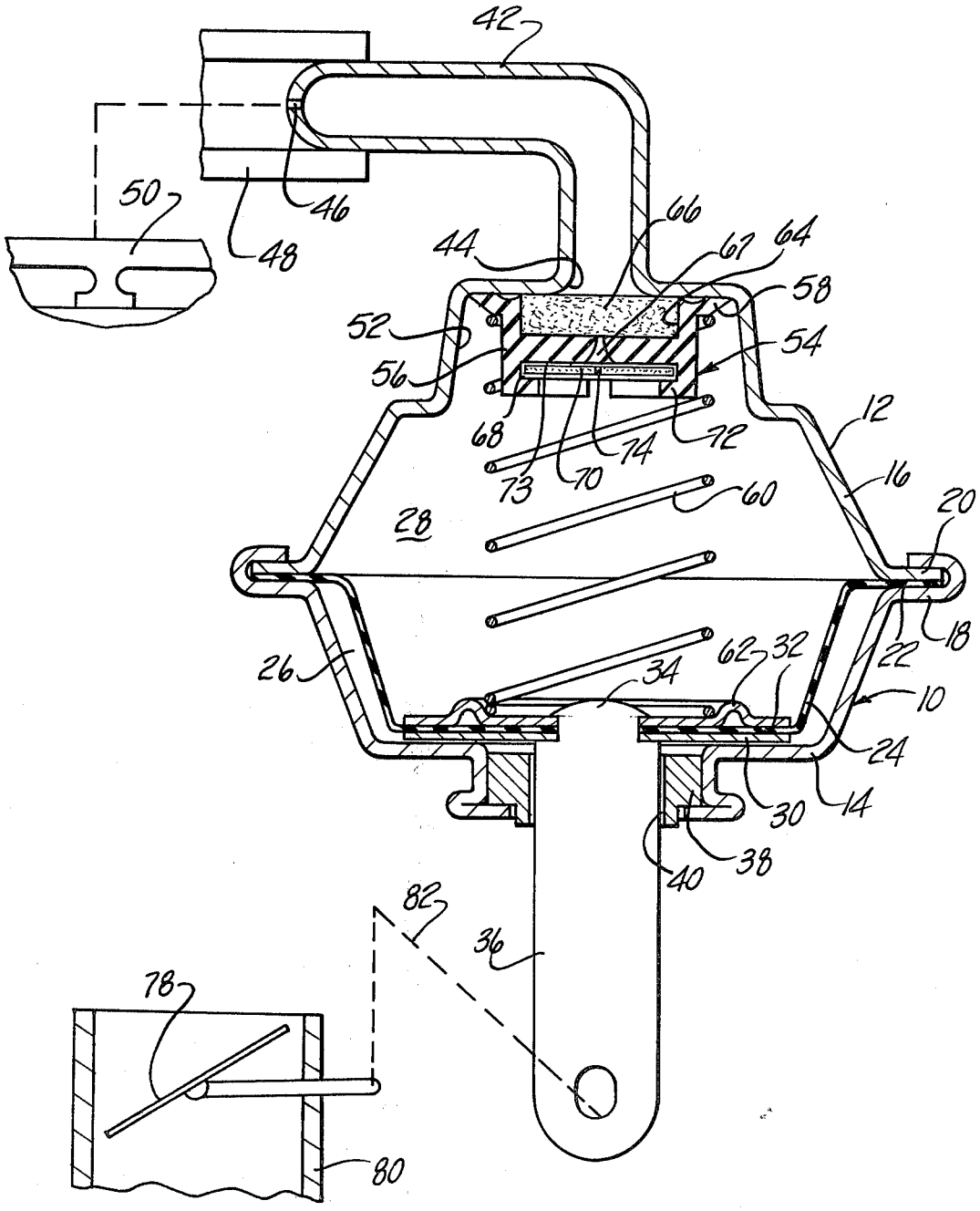
42
50
46
48
44
66
67
64
58
52
54
56
68
72
74
73
70
12
16
60
28
20
18
22
26
62
32
34
10
24
14
30
38
40
82
36
78
80

VACUUM CONTROL ASSEMBLY

This invention related to vacuum controls and more particularly to reciprocating vacuum motors of the type used for control of choke valves of carburetors used with internal combustion engines.

A variety of vacuum control motors are used on automotive vehicles and in particular in association with carburetor controls. For example, choke control devices sometimes called vacuum breaks are used to move a carburetor choke control valve from its closed to its open position upon starting of an internal combustion engine because the engine is not warmed up enough to actuate temperature responsive controls for moving the choke to its open position. Such devices are intended to operate with a certain amount of delay so that movement of the choke valve to its open position is not instantaneous but rather requires a period of several seconds. Such devices are relatively small and difficult to assemble and simplicity is highly desirable. Also, such devices operate in response to movement of small volumes of air and their operation requires clean air without leakage and at the same time the parts must tolerate any gasoline fumes that may be present. In addition, since different controls and engines have different requirements, such devices must be easily modified to accomodate a large range of engines.

An object of the invention is to provide a vacuum control assembly including a time delay valve supported in operating position without the requirement of fasteners, press fits or welding.

Still another object of the invention is to provide a vacuum operated control assembly affording time delay incorporating a minimum number of parts but providing multiple functions of supporting and locating various components such as filters and valve closure elements.

These and other objects of the invention are accomplished by the embodiment disclosed in the following description and illustrated in the drawing which is a longitudinal cross sectional view of a vacuum servomotor embodying the invention shown in association with the components of internal combustion engines illustrated diagramatically.

The time delay valve embodying the invention is designated generally at 10 and includes a generally cylindrical housing 12 made up of a pair of dish-shaped cover members 14 and 16. The covers 14 and 16 have flanges 18 and 20 which clamp the flange 22 of a diaphragm 24 to divide the interior of the housing 12 into a constant pressure chamber 26 and a variable pressure, control chamber 28. The diaphragm 24 is provided with a pair of backing plates 30 and 32 at opposite sides of the diaphragm which are held together by a riveted head portion 34 of an actuating member 36. The actuating member 36 slidably extends from the housing 12 through a bearing 38 supported by the cover 14. The bearing 38 is provided with a relatively large opening 40 around the actuating member or stem 36 to maintain the constant pressure chamber 26 in continuous communication with the exterior of the housing 12 and therefore with the atmosphere.

The cover member 16 is provided with a bent tube 42 which forms an inlet port 44 axially of the housing 12. The bent tube 14 is connected by way of an opening 46 and a tube 48 to a source of a vacuum signal such as the intake manifold of an internal combustion engine indicated generally at 50.

The rear cover 16 is provided with a cup-shaped recess 52 axially aligned with the inlet port 44 and forming part of the control chamber 28. The cup-shaped recess 52 receives and supports a timing valve assembly 54. The valve assembly 54 includes a body member 56 made of a resilient, rubber-like material. Preferably, the material is a synthetic rubber, resistant to gasoline fumes and has a Durometer of about 50 D. The body member 56 is generally cylindrical and has a circumferential portion or flange 58 formed integrally with and extending radially from the remainder of the body member. The flange 58 acts as a seat for one end of a spring 60, the other end of which engages the backing plate 32 within the confines of an annular lip 62. The cylindrical portion of the body member acts to center one end of the spring 60 which acts against the flange 58 and forms the sole means for holding the valve assembly in position against the bottom of the cup-shaped recess 52. The flange 58 forms a seal to prevent passage of air.

The body member 56 is provided with a cavity 64 which receives a disc-shaped air filter 66. The filter 66 is held in position by the bottom wall of cup-shaped portion 52 and the body member 54. The cavity 64 communicates through a flared opening 67 disposed axially of the body member 56 to an open compartment 68. The compartment 68 holds a disc-shaped valve closure element 70. The closure element 70 preferably is made of "MYLAR" and is loosely held in position in compartment 68 by an annular flange 72 formed integrally with the body member 56. Because of the resilient material making up the body member 56, the annular flange 72 is sufficiently flexible to permit the easy insertion of the closure element 70 and yet is rigid enough to contain the closure element 70 during all operating conditions.

The closure element 70 is intended to move between a seated position in which it is in engagement with a seating surface 73 and an open position in which it is separated from the surface 73 surrounding the flared opening 67. The closure element 70 is provided with a small opening 74 which is carefully sized to permit limited, metered air flow from the control chamber 28 upon the application of vacuum at the inlet port 44. In actual practice, the opening 74 is formed by a laser which makes it possible not only to accurately control the size of the openings but to make the openings very small. A laser has been used to make openings with diameters of 0.003 to 0.010 of an inch in the valve discs 70. When the element 70 is seated, the small opening 74 is in alignment with the large end of the flared opening 67 even if the element 70 is misaligned from the axis of the housing 12.

In the normal position of the time delay valve 10 before it is operated, the various parts occupy the position illustrated in the drawing with the closure element 70 in a variety of possible positions within compartment 68. Before the engine is started, atmospheric air pressure exists in the constant pressure chamber 26 and in the control chamber 28. Because of the equal pressures at opposite sides of the diaphragm 24, the diaphragm assembly and actuating member 36 are under the influence of the spring 60 which urges the parts downwardly as viewed in the drawing.

Upon starting of the internal combustion engine with which the manifold 50 is associated, vacuum pressure is established in the bent tube 42 and at the inlet port 44. Because of the atmospheric pressure present in control chamber 28, the valve disc 70 is subject to a differential pressure and seats on surface 76 and substantially closes the flared opening 67. However, the metering opening 74 permits restricted air flow so that pressure in control chamber 28 is reduced relatively slowly. When the pressure in control chamber 28 has been reduced enough to create a sufficient pressure differential across the diaphragm 24 to overcome the force of the spring 60, the diaphragm 24 and stem 36 move upwardly. Such movement typically is used to operate a choke valve 78 of a carburetor 80. The actuator 36 is connected by linkages indicated diagrammatically at 82 to move the choke valve 78 from its closed position and to maintain it in an open position during the time that the internal combustion engine is operating.

When the internal combustion engine with which the intake manifold 50 is associated stops running, the source of vacuum is eliminated at the inlet port 44 and atmospheric pressure is reestablished. Because of vacuum pressure in the control chamber 28, a differential is created across the disc valve closure element 70 causing it to separate from its seating surface 73 to uncover the flared opening 67 and permit free air flow around the closure element 70 to reestablish atmospheric pressure in the control chamber 28. As a consequence, when the internal combustion engine stops running and the source of vacuum pressure is terminated, the actuating member 36 moves rapidly downwardly under the action of spring 60 to return the choke valve 78 to its closed position.

The time delay in operation of the valve assembly 10 can be modified by substituting valve closure elements 70 with different sized metering openings 74. Consequently, time delay valves 10 with different operating characteristics may be provided simply by a variation in one component, namely, the valve closure element 70.

A time delay valve has been provided wherein a valve assembly has a unitary body member held in mounted position by a diaphragm return spring to form a fluid tight seal between the body member and its containing housing structure. The body member forms a mounting for an element filtering control air, a compartment for containing a movable valve closure element and a spring guide and seat for the diaphragm return spring thus avoiding the use of multiple parts and fasteners and minimizing leakage problems.

The embodiments of the invention in which an exclusive property or privilege is claimed are defined as follows:

1. A vacuum control assembly comprising: a generally cylindrical housing, a movable diaphragm assembly supported in and dividing the housing into a variable pressure control chamber and a constant pressure chamber at opposite sides of said diaphragm, the constant pressure chamber being in continuous communication with the atmosphere, an inlet port formed axially of the housing and communicating with the control chamber and being adapted for connection to a source of vacuum, the diaphragm assembly being movable from a first to a second position in response to vacuum pressure in the other of the chambers, the housing forming a cup-shaped recess axially aligned with the inlet port and communicating with the control chamber, a valve assembly having a flexible, resilient body member supported in the cup-shaped recess, the body member having a circumferential portion engageable with walls of the cup-shaped recess to locate the body member axially of the housing, resilient means acting between the diaphragm and the body member to urge the body member into sealing engagement with the bottom of the cup-shaped recess, the body member forming an open compartment, a passage communicating the compartment with the inlet port, a valve closure element being disposed in the compartment, a resilient flange formed by the body member at one end of said compartment for releasably confining the valve closure element in the cavity for movement between a first position in engagement with the flexible body member to close the passage in the presence of vacuum pressure in the inlet port and to a second position spaced from the passage in the absence of vacuum pressure in the inlet port to permit relatively unrestricted air flow to the control chamber, and means forming a passage in the valve assembly permitting restricted air flow between the inlet port and the control chamber when the valve closure element is in its first position to retard movement of said diaphragm assembly.

2. The vacuum motor of claim 1 wherein said circumferential portion is a resilient flange forming an integral part of the body member and is deflectable axially into engagement with an interior wall of the housing to form a fluid tight seal.

3. The vacuum motor of claim 2 wherein the resilient means is a coil spring extending axially of said housing and surrounding said body member, said spring being seated on and engaging the flange to press it into sealing engagement with the wall of the housing.

4. The vacuum motor of claim 1 wherein the valve closure element is a disc and wherein the means forming a passage in the valve assembly is an opening disposed axially in said disc.

5. The vacuum motor of claim 4 wherein said passage communicating the compartment and the inlet port has an opening adjacent the compartment larger than the opening in the disc to maintain communication between the passage and the opening when the disc is misaligned with the axis of the body member.

6. The vacuum motor of claim 1 wherein said body member forms a cavity adjacent to the wall of the housing, said cavity supporting a filter at one end of said passage.

7. A vacuum motor of claim 1 wherein the diaphragm assembly includes an actuator member projecting through a wall of the housing.

8. The vacuum motor of claim 7 and further comprising a choke valve of a carburetor, said actuator being connected to said choke valve.

9. In a carburetor system for an internal combustion engine, the combination of a carburetor, a choke valve in said carburetor, a vacuum control assembly having a generally cylindrical housing, a movable diaphragm assembly in the housing forming a control chamber and an atmospheric pressure chamber at opposite sides of said diaphragm and having an actuator member slidably extending from said housing, said actuating member being connected to said choke valve for movement of the latter in response to movement of said diaphragm, an inlet port connected with a vacuum signal source and communicating with said control chamber, a cup-shaped recess formed by a wall of the housing and axially aligned with the inlet port and open to the control chamber, a timing valve assembly having a flexible, resilient body member supported in the cup-shaped recess, the body member having a circumferential portion engageable with the walls of the cup-shaped recess to locate the body member axially of the housing, resilient means acting between the diaphragm and the body member to urge the body member into sealing engagement with the bottom of the cup-shaped recess, the body member forming a pair of oppositely opening compartments axially aligned with each other, a passage communicating the compartments, a filter member in one of the compartments nearest the inlet port, a valve closure element disposed in the other of the compartments, the other of the compartments having a resilient flange formed by the body member at the open end of that compartment for releasably and loosely confining the valve closure element for movement between positions in engagement with the flexible member to close the passage in the presence of vacuum pressure at the inlet port and to a second position spaced from the passage in the absence of vacuum pressure in the inlet port to permit relatively unrestricted air flow to the control chamber, and means forming a passage in the valve assembly permitting restricted air flow between the inlet port and control chamber when the valve closure element is closing said passage to retard movement of the diaphragm assembly.

* * * * *